US009987850B2

(12) United States Patent
Maxfield et al.

(10) Patent No.: US 9,987,850 B2
(45) Date of Patent: Jun. 5, 2018

(54) PRINTHEAD ASSEMBLY

(71) Applicant: HEWLETT-PACKARD DEVELOPMENT COMPANY, L.P., Houston, TX (US)

(72) Inventors: David Maxfield, Philomath, OR (US); Sean P. McClelland, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/434,523

(22) Filed: Feb. 16, 2017

(65) Prior Publication Data

US 2017/0157940 A1 Jun. 8, 2017

Related U.S. Application Data

(63) Continuation of application No. 13/985,578, filed as application No. PCT/US2011/030731 on Mar. 31, 2011, now Pat. No. 9,610,772.

(51) Int. Cl.
*B41J 2/14* (2006.01)
*B41J 2/175* (2006.01)

(52) U.S. Cl.
CPC ..... *B41J 2/17523* (2013.01); *B41J 2/17553* (2013.01)

(58) Field of Classification Search
CPC .. B41J 2/17523; B41J 2/17553; B41J 2/1433; B41J 1/00
See application file for complete search history.

(56) References Cited

U.S. PATENT DOCUMENTS 5,512,923 A 4/1996 Bauman
5,724,079 A 3/1998 Helinski et al.
6,017,113 A 1/2000 Nicoloff, Jr. et al.
6,151,045 A * 11/2000 Beach ..... B41J 2/1433 347/45
6,220,698 B1 4/2001 Katakura
6,334,666 B1 1/2002 Inui
6,341,842 B1 * 1/2002 Beach ..... B41J 2/1433 347/45
6,412,935 B1 7/2002 Doumaux
6,568,790 B1 5/2003 Sugiyama
7,350,902 B2 * 4/2008 Dietl ..... B41J 2/1404 347/40
7,686,423 B2 3/2010 Sato
(Continued)

FOREIGN PATENT DOCUMENTS

CN 101092081 12/2007
EP 0772150 A1 5/1997
(Continued)

OTHER PUBLICATIONS

Supplementary European Search Report for Application EP11362312.3; Report dated Dec. 16, 2013.

*Primary Examiner* — Patrick King
(74) *Attorney, Agent, or Firm* — HP Inc. Patent Department

(57) ABSTRACT

A printhead assembly is provided, the printhead assembly including a printhead die, a black fluid slot formed in the printhead die to deliver black printing fluid, and a color fluid slot formed in the printhead die to deliver color printing fluid.

10 Claims, 4 Drawing Sheets

(56) References Cited

U.S. PATENT DOCUMENTS

| | | | | |
|---|---|---|---|---|
| 7,926,908 | B2 * | 4/2011 | Mizutani | B41J 2/2103 347/40 |
| 8,231,203 | B2 | 7/2012 | Akama | |
| 8,608,283 | B1 * | 12/2013 | Phillips | B41J 2/2103 347/43 |
| 2001/0053501 | A1 | 12/2001 | Chen et al. | |
| 2002/0113758 | A1 | 8/2002 | Nishikori | |
| 2002/0171707 | A1 | 11/2002 | Ara | |
| 2002/0191046 | A1 | 12/2002 | Otsuki | |
| 2003/0030708 | A1 * | 2/2003 | Chang | B41J 2/17513 347/87 |
| 2003/0122902 | A1 | 7/2003 | Sakaida | |
| 2003/0179262 | A1 | 9/2003 | Nishikori et al. | |
| 2003/0186613 | A1 | 10/2003 | Kawase | |
| 2003/0227505 | A1 | 12/2003 | Tanaka | |
| 2004/0021734 | A1 | 2/2004 | Otsuki | |
| 2004/0125173 | A1 * | 7/2004 | Parish | B41J 2/1404 347/59 |
| 2006/0001698 | A1 | 1/2006 | Hart | |
| 2007/0291073 | A1 | 12/2007 | Jung et al. | |
| 2008/0252698 | A1 | 10/2008 | Kudo | |
| 2009/0079790 | A1 | 3/2009 | Michinari | |
| 2009/0128600 | A1 * | 5/2009 | Nagata | B41J 2/1433 347/40 |
| 2009/0174741 | A1 * | 7/2009 | Nagata | B41J 2/1752 347/12 |
| 2013/0222489 | A1 | 8/2013 | Takahashi | |

FOREIGN PATENT DOCUMENTS

| | | | |
|---|---|---|---|
| EP | 1552930 | A2 | 7/2005 |
| WO | WO-2009139773 | A1 | 11/2009 |

* cited by examiner

PRINTHEAD ASSEMBLY

BACKGROUND

An inkjet printing system may include a printhead, an ink supply which supplies liquid ink to the printhead, and an electronic controller which controls the printhead. The printhead ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

The printhead, often referred to as a printhead die, typically includes one or more ink feed slots which route different colors or types of ink to fluid ejection chambers communicated with the nozzles or orifices of the printhead die. Because of differing throughput requirements, color swath heights may be shorter than black swath heights. Inkjet printing systems thus generally employ separate black and color printhead dies.

DETAILED DESCRIPTION

In the following detailed description, reference is made to the accompanying drawings which form a part hereof, and in which is shown by way of illustration specific examples in which the invention may be practiced. In this regard, directional terminology, such as "top," "bottom," "front," "back," "leading," "trailing," etc., is used with reference to the orientation of the figure(s) being described. Because components of examples of the present invention can be positioned in a number of different orientations, the directional terminology is used for purposes of illustration and is in no way limiting. It is to be understood that other examples may be utilized and structural or logical changes may be made without departing from the scope of the present invention. In addition, it is to be understood that any element(s), feature(s), structure(s), item(s), etc. of one specific example is not limited to the specific example, and may be used in other examples. The following detailed description, therefore, is not to be taken in a limiting sense, and the scope of the present invention is defined by the appended claims.

Figure 1:
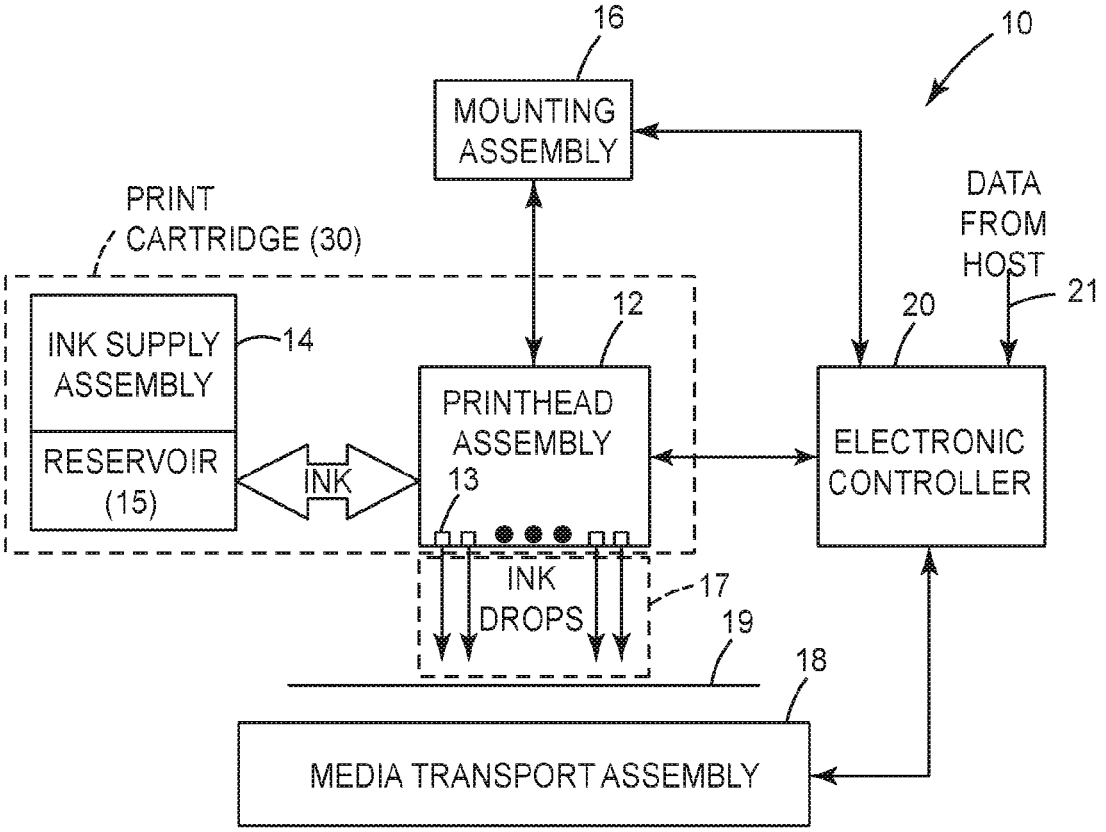
FIG. 1 is a block diagram illustrating an inkjet printing system according to an embodiment of the invention.

FIG. 1 illustrates an inkjet printing system 10 including a fluid ejection system employing a fluid ejection device, such as printhead assembly 12, and a fluid supply, such as ink supply assembly 14. In the illustrated example, inkjet printing system 10 also includes a mounting assembly 16, a media transport assembly 18, and an electronic controller 20.

Printhead assembly 12, as one example of a fluid ejection device, is formed according to an example of the present invention and ejects drops of printing fluid, such as black and colored inks, via a plurality of ejection elements 13. While the following description refers to the ejection of ink from printhead assembly 12, it is understood that other liquids, fluids, or flowable materials may be ejected from printhead assembly 12.

In one example, the drops are directed toward a medium, such as print media 19, so as to print onto print media 19. Typically, nozzles 13 are arranged in columns or arrays such that properly sequenced ejection of ink from the nozzles causes, in one example, characters, symbols, and/or other graphics or images to be printed upon print media 19 as printhead assembly 12 and print media 19 are moved relative to each other.

Print media 19 includes, for example, paper, card stock, envelopes, labels, transparent film, cardboard, rigid panels, and the like. In one example, print media 19 is a continuous form or continuous web print media 19. As such, print media 19 may include a continuous roll of unprinted paper.

Ink supply assembly 14, as one example of a fluid supply, supplies ink to printhead assembly 12 and includes a reservoir 15 for storing ink. As such, ink flows from reservoir 15 to printhead assembly 12. In some examples, ink supply assembly 14 and printhead assembly 12 may form a recirculating ink delivery system. As such, ink may flow back to reservoir 15 from printhead assembly 12. Printhead assembly 12 and ink supply assembly 14 may be housed together in a print cartridge or pen, as identified by dashed line 30. In some examples, the ink supply assembly may be separate from the printhead assembly, and may supply ink to the printhead assembly through an interface connection, such as a supply tube (not shown).

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined in an area between printhead assembly 12 and print media 19. During printing, print media 19 is advanced through print zone 17 by media transport assembly 18.

Printhead assembly 12 may take the form of a scanning-type printhead assembly, where mounting assembly 16 moves printhead assembly 12 relative to media transport assembly 18 and print media 19 during printing of a swath on print media 19. As will be described further below, swath height at least in part determines throughput of print media 19.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

Electronic controller 20 typically provides control of printhead assembly 12 including timing control for ejection of ink drops by ejection elements 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one example, logic and drive circuitry forming a portion of electronic controller 20 is located on printhead assembly 12. In another example, logic and drive circuitry forming a portion of electronic controller 20 is located off printhead assembly 12.

Figure 2:
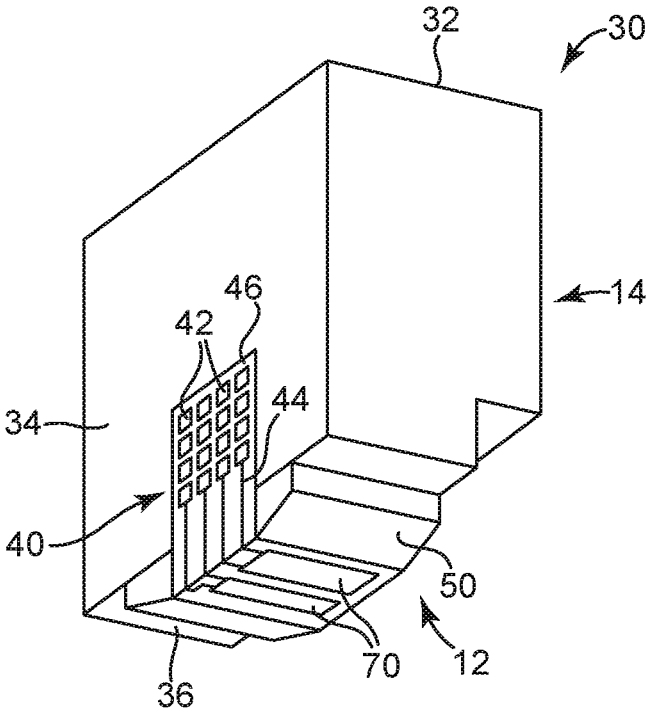
FIG. 2 is a perspective view illustrating an inkjet print cartridge according to an embodiment of the invention.

Turning now to FIG. 2, an example print cartridge is shown at 30, the print cartridge including a printhead assembly 12 and a printing fluid supply in the form of ink supply assembly 14. The printhead assembly and ink supply cartridge are coupled or joined together to form print cartridge 30. Print cartridge 30 thus includes a body or housing 32 which supports printhead assembly 12 and contains reservoir 15 (FIG. 1) of ink supply assembly 14. As such, reservoir 15 communicates with printhead assembly 12 to supply ink to printhead assembly 12. In addition, housing 32 supports an electrical circuit 40 which facilitates communication of electrical signals between electronic controller 20 (FIG. 1) and printhead assembly 12 for controlling and/or monitoring operation of printhead assembly 12.

In one example, electrical circuit 40 includes a plurality of electrical contacts 42 and a plurality of conductive paths 44 which extend between and provide electrical connection between electrical contacts 42 and printhead assembly 12. Electrical contacts 42 provide points for electrical connection with print cartridge 30 and, more specifically, printhead assembly 12. As such, electrical contacts 42 facilitate communication of power, ground, and/or data signals to printhead assembly 12. In some examples, electrical circuit 40 may be supported by print cartridge 30 such that electrical contacts 42 are provided along a side 34 of housing 32 of print cartridge 30.

Electrical circuit 40 may be a flexible electrical circuit. As such, conductive paths 44 may be formed in one or more layers of a flexible base material 46. Base material 46 may include, for example, a polyimide or other flexible polymer material (e.g., polyester, poly-methyl-methacrylate) and conductive paths 44 may be formed of copper, gold, or other conductive material.

Printhead assembly 12 is a modular printhead assembly formed of separate components including a base 50, a substrate 60 (FIG. 3), and a printhead die 70. Base 50 and substrate 60 mate with each other and are configured such that base 50 and substrate 60 provide mechanical support for and accommodate fluidic routing to printhead die 70.

Figure 3:
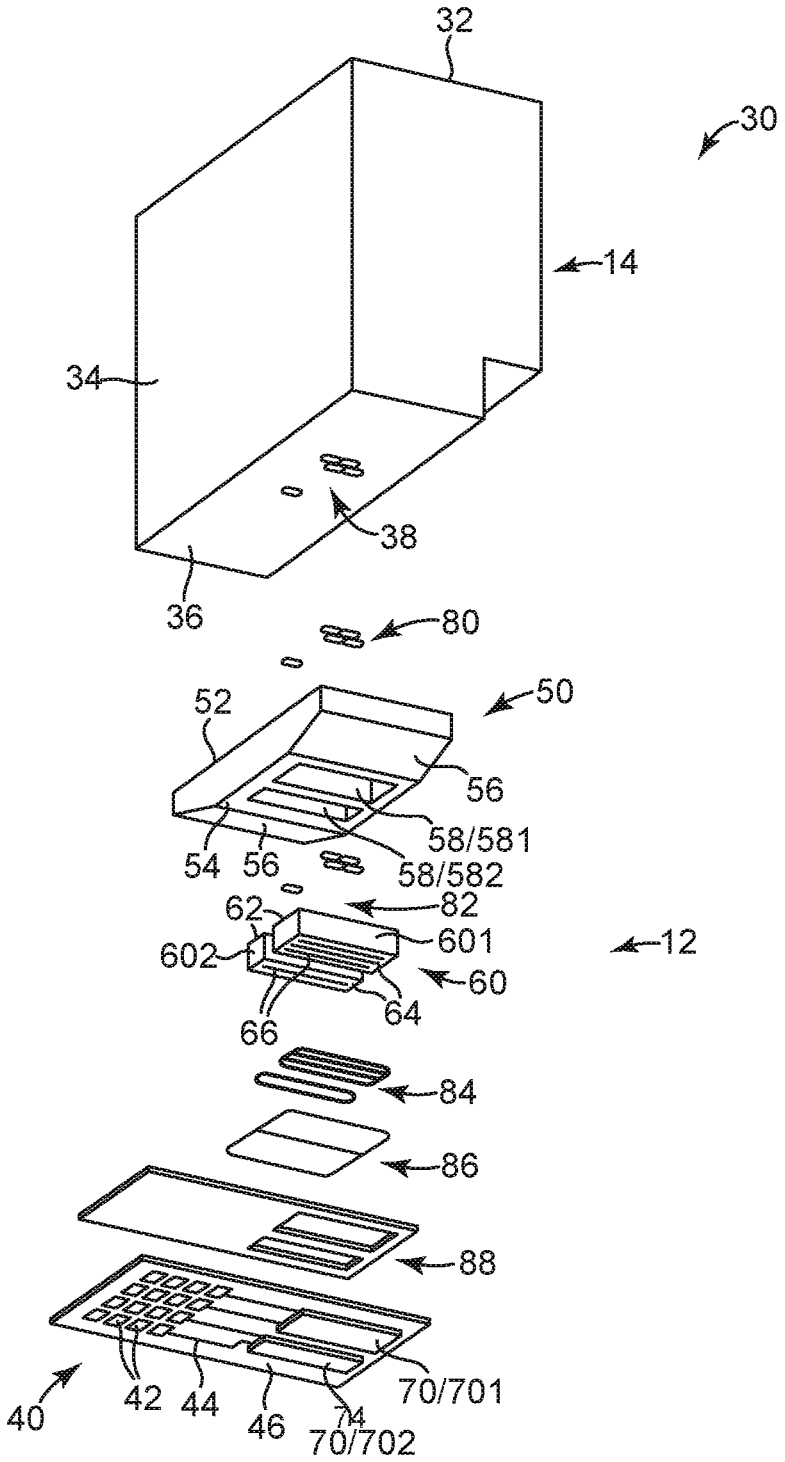
FIG. 3 is an exploded perspective view showing the inkjet print cartridge of FIG. 2.

Referring now to FIGS. 2 and 3, base 50 has a first side 52 and a second side 54, which is opposite first side 52. In one example, base 50 is supported by housing 32. More specifically, first side 52 of base 50 is secured to or mounted on a side 36 of housing 32. Fluid outlets 38 (in fluid communication with reservoir 15 (FIG. 1) of ink supply assembly 14) are provided on side 36 of housing 32. Base 50 is mounted on side 36 of housing 32 so as to accommodate and/or communicate with fluid outlets 38.

Base 50 is secured to or mounted on housing 32 so as to provide a fluid-tight seal with housing 32. For example, first side 52 of base 50 may be secured to or mounted on side 36 of housing 32 by use of an adhesive 80 provided between base 50 and housing 32. Other connection methods providing a fluid-tight seal between base 50 and housing 32 may also be used.

In one example, base 50 includes ramped surfaces 56. Ramped surfaces 56 are provided on opposite ends of second side 54 of base 50 and aid in preventing crashes between printhead assembly 12 and print media 19 (FIG. 1) as printhead assembly 12 and print media 19 are moved relative to each other during printing.

Base 50 defines a pocket 58 into which substrate 60 fits. Pocket 58 is open at least to second side 54 of base 50 and is sized and configured to receive and support substrate 60. As indicated in FIG. 3, substrates 60 has a first side 62 and a second side 64, which is opposite first side 62. Substrate 60 is fit or received within a respective pocket 58 of base 50. More specifically, substrate 60 is fit or received within pocket 58 such that second side 64 of substrate 60 is adjacent second side 54 of base 50. As such, pocket 58 positions substrate 60 relative to housing 32, and positions substrate 60 for supporting printhead die 70. In some examples, pocket 58 and/or substrate 60 includes various features (e.g., datum pads and/or lockout features) to ensure correct orientation and retention (e.g., press fit) of substrate 60 within pocket 58.

Substrate 60 may be formed of a plastic, ceramic, glass, or other suitable material. When substrate 60 is formed of a plastic material, filler materials such as glass, carbon fibers, minerals, or other suitable filler materials may also be used. In addition, substrate 60 may be formed by a number of methods such as injection molding, pressing, machining, or etching depending on the substrate material.

Substrate 60 is secured or mounted within pockets 58 so as to provide a fluid-tight seal with base 50. For example, first side 62 of substrate 60 may be secured or mounted within pocket 58 by use of an adhesive provided between substrate 60 and base 50. Other connection methods providing a fluid-tight seal between substrate 60 and base 50 may also be used.

Area or footprint of substrate 60 may be approximately the same as an area or footprint of a respective printhead die 70 to provide support for the respective printhead die 70. More specifically, a length and a width of second side 64 of substrate 60 approximates or is substantially equal to a length and a width of a respective printhead die 70. In addition, substrate 60 has fluid passages 66 formed therethrough. Fluid passages 66 communicate with first side 62 and second side 64 of substrate 60 and provide fluidic routing for printhead die 70, as described below.

In one example, printhead die 70 includes a thin-film structure formed on a substrate. The substrate is formed, for example, of silicon, glass, or a stable polymer, and the thin-film structure includes a conductive layer and one or more passivation or insulation layers. As will be described further below, printhead die 70 defines a plurality of fluid slots 72 (FIG. 4), which communicate printing fluid from printing fluid supply 14 to ejection elements formed on the printhead die. The ejection elements, in turn, eject fluid through nozzles of corresponding nozzle arrays 74. Each nozzle array 74 thus may be associated with a different printing fluid, according to the particular printing parameters desired. Although nozzle arrays 74 are shown as each including a single column of nozzles, each nozzle array may include one, two or more columns of nozzles fed by a single fluid slot. Other nozzle configurations also are possible Printhead die 70 may be joined with or mounted on electrical circuit 40 such that printhead die 70 and electrical circuit 40 are supported by substrate 60 and base 50. Printhead die 70 is supported by substrate 60 so as to communicate with respective fluid passages 66. As such, fluid passages 66 of substrates 60 provide fluidic routing to printhead die 70 through base 50. In one example, electrical circuit 40 wraps around and is supported by side 34 of housing 32 of print cartridge 30, as described above.

Printhead die 70 and electrical circuit 40 are secured to or mounted on substrate 60 and base 50 so as to provide a fluid-tight seal with substrate 60 and base 50. In one example, printhead die 70 is secured to or mounted on second side 64 of substrates 60 by use of an adhesive 84 provided between printhead die 70 and substrate 60, and electrical circuit 40 is secured to or mounted on second side 54 of base 50 by use of an adhesive 86 provided between electrical circuit 40 and base 50. An attach layer 88 may be interposed between electrical circuit 40 and base 50. Other connection methods providing a fluid-tight seal between printhead die 70 and substrate 60, and between electrical circuit 40 and base 50 may also be used.

Figure 4:
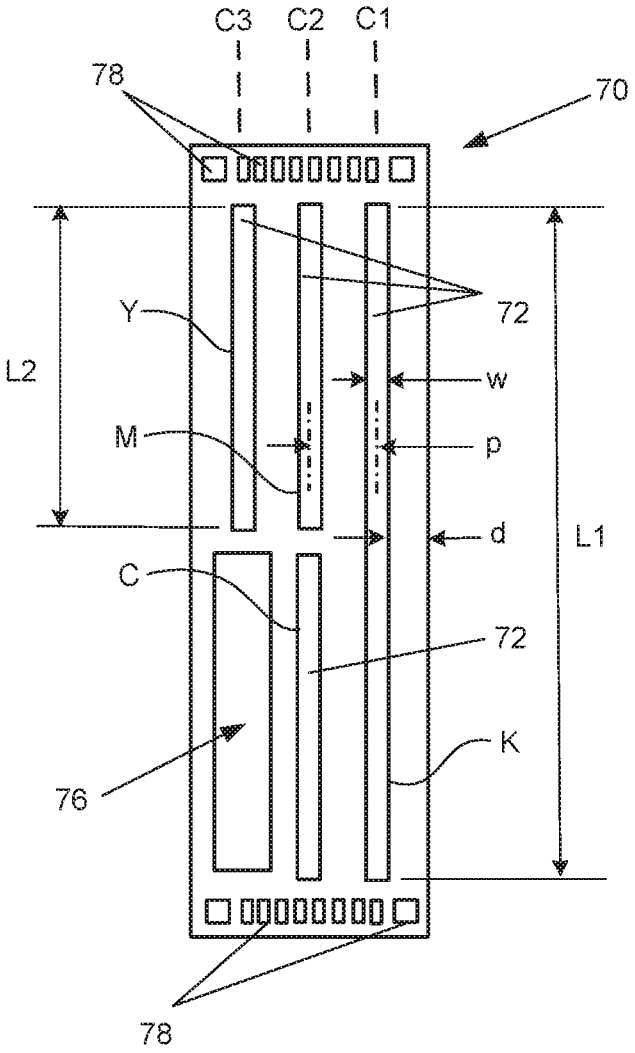
FIG. 4 is a somewhat schematic plan view of a printhead die according to an embodiment of the invention.

FIG. 4 illustrates an example fluid slot layout, whereby both black (K) and color (C, M, Y) printing fluids may be delivered via the same printhead die 70. In FIG. 4, printhead die 70 is shown with the nozzle layer removed so as to expose fluid slots 72 and drive circuitry 76. For clarity, ejection elements and trace routing also are not shown in FIG. 4. Fluid slots 72 correspond to nozzle arrays 74, and thus are indicative of swath heights generated by each nozzle array.

As indicated in FIG. 4, in some examples, printhead die 70 may define a black fluid slot K having a black slot length L1 that is 90 percent (or more) of the length of the printhead die. Printhead die 70 thus may print a black swath having a height that approximates the overall length of the printhead die. In one example, the slot length L1 of black fluid slot K is approximately 9/16-inch (14.3 millimeters) for a die having an overall length of approximately 15.5 millimeters. The black fluid slot thus extends substantially the length of the printhead die (e.g., all but the distance required above and below the slot to preserve structural integrity of the printhead die). To preserve structural integrity of the die, the fluid slot is spaced a distance d from the edges of the printhead die. In one example, the distance d is approximately 0.63 millimeters.

Printhead die 70 also may define color fluid slots, such as cyan fluid slot C, magenta fluid slot M and yellow fluid slot Y. Although cyan, magenta, and yellow fluid slots are described, other colors may be used with similar effect. Furthermore, although three colors (plus black) are described, more or fewer colors may be used.

In the present example, the black and color fluid slots are be arranged in laterally spaced columns C1, C2, C3 to maximize use of available space, and minimize footprint of the printhead die. The columns are substantially parallel, and substantially uniformly spaced such that fluid slots 72 have a pitch p, which may be determined at least in part by the width w of the fluid slots and the structural characteristics of the printhead die. In one example, fluid slots 72 have a pitch p of approximately 1.2 millimeters.

Where target throughput of color printing is less than target throughput of black printing, color swath height may be less than black swath height. Correspondingly, color fluid slots C, M, Y may each have a color slot length L2 that is shorter than black slot length L1. Color slot length L2 may be half the length of black slot length, or less. In one example, color fluid slots C, M, Y each have a color slot length L2 that is approximately 45 percent of black slot length L1. Accordingly, column C1 may be defined by a single black fluid slot K, and column C2 may be defined by a pair of color fluid slots C, M, and still have sufficient spacing between the color fluid slots (in column C2) to preserve structural integrity of the printhead die 70. Column C2 thus may be defined by first and second color fluid slots that have a collective slot length corresponding to the black slot length.

As shown, column C3 may be defined by a single color fluid slot Y. Because color fluid slot Y covers only approximately half of the length of column C3, the remaining landscape in column C3 may be used to house drive circuitry 76. This columnar arrangement allows for relatively tall and wide circuit layout, as compared to designs where drive circuitry 76 is horizontally positioned above and/or below the fluid slots.

Power and control may be provided to circuitry 76 via connection pads 78 and trace routing (not shown). Connection pads 78 may be in any number of configurations, and may be sized to fit within the distance d between the edge of printhead die 70 and the fluid slots 72. Although connection pads are shown, in FIG. 4 as being present above and below fluid slots 72, connection pads may be positioned above, below, and/or beside the fluid slots, in any arrangement that suits available space and desired power and control routing. In some examples, connection pads 78 may be positioned along the edge adjacent the black fluid slot K so as to minimize voltage drop to the ejection elements associated with the black fluid slot, where there may be higher power requirements. In other examples, connection pads 78 may be integrated into circuitry 76 to further reduce printhead die size.

Because black slot length L1 is approximately twice color slot length L2, printhead die 70 will print with a black swath height that is approximately twice the color swath height. For a print cartridge having a color swath height of approximately 1/4-inch (6.4 millimeters), a black swath height of approximately 9/16-inch (14.3 millimeters) may be achieved with a single printhead die 70. Correspondingly, printhead die 70 will accommodate black printing throughput that is approximately twice color printing throughput. This is in line with desired color printing throughput requirements. Furthermore, where the cyan fluid slot C and magenta fluid slot M are stacked, as shown in FIG. 4, bi-directional hue shifts will be minimized.

Use of a single printhead may reduce costs of printhead materials, and of materials for connecting power and control to separate printhead dies, and may reduce power consumption (due to elimination of duplicate signals and narrower print heads). A single printhead die also may reduce alignment margins, and may improve IQ/PQ (due to reduced pitch), and may avoid the capitol cost of a second bonder used in securing a second printhead die to a substrate. Additional savings are also enabled in servicing, and in the potential reduction in size of cartridge body.

Although specific examples have been illustrated and described herein, it will be appreciated by those of ordinary skill in the art that a variety of alternate and/or equivalent implementations may be substituted for the specific examples shown and described without departing from the scope of the present invention. This application is intended to cover any adaptations or variations of the specific examples discussed herein. Therefore, it is intended that this invention be limited only by the claims and the equivalents thereof.

What is claimed is:

1. A print cartridge, comprising:

a reservoir to hold printing fluid;

a housing to contain the reservoir; and a printhead assembly disposed on the housing, the printhead assembly comprising:

a printhead die to eject the printing fluid from the reservoir;

a first column defined by a black fluid slot formed in the printhead die;

a second column defined by first and second color fluid slots formed in the printhead die; and a third column defined by a third color fluid slot and drive circuitry;

wherein:

the first column, the second column, and the third column are the same length; and the black fluid slot is longer than each of the first color fluid slot, the second fluid color slot, and the third color fluid slot.

2. The print cartridge of claim 1, wherein the printhead assembly further comprises a number of nozzle arrays corresponding to the fluid slots.

3. The print cartridge of claim 1, wherein the first color fluid slot, the second color fluid slot, and the third color fluid slot are different from one another such that the printhead die supports various color printing fluids.

4. The print cartridge of claim 1, wherein the first color fluid slot, the second color fluid slot, and the third color fluid slot are each less than half the length of the black fluid slot.

5. The print cartridge of claim 1, wherein the printhead assembly further comprises:

a base secured to the housing;

a substrate disposed within a pocket of the base;

wherein:

the substrate and the base support the printhead die; and fluid is passed from the reservoir to the printhead die via fluid passages in the substrate.

6. The print cartridge of claim 1, wherein the printhead die is mounted on an electrical circuit.

7. A print cartridge, comprising:

a reservoir to hold printing fluid;

a housing to contain the reservoir; and a printhead assembly disposed on the housing, the printhead assembly comprising:

a printhead die to eject the printing fluid from the reservoir;

a first column defined by a black fluid slot formed in the printhead die, the black fluid slot having a black slot length extending along the printhead die length;

a second column defined by first and second color fluid slots formed in the printhead die, the first and second color fluid slots being laterally spaced from the black fluid slot, and the first and second color fluid slots being disposed at different positions along the length of the printhead die; and a third column parallel to the first and second columns, the third column comprising a third color fluid slot and drive circuitry, the drive circuitry being located in a first position of the third column and the third color fluid slot being located in a second portion of the third column, wherein the first and second portions of the third column are spaced apart.

8. The print cartridge of claim 7, wherein the printhead assembly further comprises a number of nozzle arrays corresponding to the fluid slots.

9. The print cartridge of claim 7, wherein the printhead assembly further comprises:

a base secured to the housing;

a substrate disposed within a pocket of the base;

wherein:

the substrate and the base support the printhead die; and fluid is passed from the reservoir to the printhead die via fluid passages in the substrate.

10. The print cartridge of claim 9, wherein at least one of the pocket and substrate include features to ensure correct orientation and retention of the substrate within the pocket.

* * * * *